US010843457B2

(12) United States Patent
Boadas Matamala

(10) Patent No.: US 10,843,457 B2
(45) Date of Patent: Nov. 24, 2020

(54) ADAPTING SLEEVE WITH HYDRAULIC PADS FOR A FLEXOGRAPHIC PRINTING MACHINE

(71) Applicant: Rossini Spain Printing Rollers SAU, Barcelona (ES)

(72) Inventor: Javier Boadas Matamala, Barcelona (ES)

(73) Assignee: Rossini Spain Printing Rollers SAU, Barcelona (ES)

( * ) Notice: Subject to any disclaimer, the term of this patent is extended or adjusted under 35 U.S.C. 154(b) by 199 days.

(21) Appl. No.: 16/186,976

(22) Filed: Nov. 12, 2018

(65) Prior Publication Data

US 2019/0143731 A1 May 16, 2019

(30) Foreign Application Priority Data

Nov. 13, 2017 (ES) ..... 201731317

(51) Int. Cl.
*B41F 27/10* (2006.01)
*B41F 13/20* (2006.01)
(Continued)

(52) U.S. Cl.
CPC ..... *B41F 27/105* (2013.01); *B41F 5/24* (2013.01); *B41F 13/085* (2013.01); *B41F 13/20* (2013.01); *B41F 27/14* (2013.01); *B41N 6/00* (2013.01)

(58) Field of Classification Search
CPC ..... B65H 27/14; B65H 75/24; B41P 2227/21; B41P 2227/20; B41F 27/105
See application file for complete search history.

(56) References Cited

U.S. PATENT DOCUMENTS 4,111,569 A * 9/1978 Mengel ..... B23B 31/305 279/2.08
4,651,643 A 3/1987 Katz et al.
(Continued)

FOREIGN PATENT DOCUMENTS

DE 10023742 11/2001
EP 0683046 A1 * 11/1995 ..... B41F 27/105

OTHER PUBLICATIONS

Decision to Grant, ES Application No. 201731317, dated Oct. 9, 2019, with English Translation 9 pages.
(Continued)

*Primary Examiner* — Jennifer E Simmons
(74) *Attorney, Agent, or Firm* — Dority & Manning, P.A.

(57) ABSTRACT

An adapting sleeve for flexographic printing machines defines an exterior surface appropriate for the mounting of a printing sleeve. The adapting sleeve has an outer cylindrical member made of a rigid material and surrounding an inner cylindrical member that defines a cylindrical passage for mounting of the adapting sleeve on a rotary core of a flexographic printing machine. The adapting sleeve has some ring separators that are mounted between the outer cylindrical member and the inner cylindrical member and spaced longitudinally from each other. The adapting sleeve has a hydraulic device that includes hydraulic pads arranged between the inner surface of the inner cylindrical member and the ring separators and connected by a hydraulic circuit to a pressurization element that is actionable manually from the exterior of the adapting sleeve.

16 Claims, 4 Drawing Sheets

(51) Int. Cl.

| | |
|---|---|
| ***B41F 13/08*** | (2006.01) |
| ***B41F 5/24*** | (2006.01) |
| ***B41F 27/14*** | (2006.01) |
| *B41N 6/00* | (2006.01) |

(56) References Cited

U.S. PATENT DOCUMENTS

| | | | | |
|---|---|---|---|---|
| 5,840,386 | A | 11/1998 | Hatch et al. | |
| 9,120,302 | B2 | 9/2015 | Rossini | |
| 9,126,395 | B2 | 9/2015 | Rossini | |
| 2004/0079250 | A1* | 4/2004 | Lorig | B41F 27/105 101/375 |

OTHER PUBLICATIONS

Spanish Search Report, ES Application No. 201731317, dated Jun. 7, 2018, 6 pages.
Written Opinion on Patentability, ES Application No. 201731317, dated Jun. 7, 2018, 10 Pages.

* cited by examiner

ADAPTING SLEEVE WITH HYDRAULIC PADS FOR A FLEXOGRAPHIC PRINTING MACHINE

CROSS-REFERENCE TO RELATED APPLICATIONS

Not applicable.

FIELD OF THE INVENTION

The subject matter disclosed herein generally involves an adapting sleeve intended to be mounted on the rotary core of a flexographic printing machine and that in turn allows the mounting of printing sleeves on this adapting sleeve. These adapting sleeves are also known variously as adaptor sleeves, bridge sleeves or carriers.

BACKGROUND

Basically, as it is known in the state of the art, these adapting sleeves have the purpose of supplementing the diameter of the rotary core of the flexographic printing machines, with the purpose of allowing the use of different development printing sleeves on this machine.

Assuming that the outer diameter of the rotary core of a printing machine on the flexographic printing area is concentric with its rotation axis, so as the rotation speed of the printing sleeve that is mounted on this rotary core increases, then maintaining acceptable printing quality is increasingly dependent on keeping a fixed and invariable radial distance between the outer diameter of the rotary core and the inner diameter of the printing sleeve. If this radial distances changes, then the printing quality decreases. A decreased printing quality takes the form of portions of the image with faded or no ink, alternating with portions of the image with dark ink.

As this printing sleeve and the core rotate, variation in this desired fixed and invariable radial distance can occur if the printing sleeve experiences vibration. This variation in the fixed and invariable radial distance can arise when an asymmetric printing surface of the printing sleeve causes an irregular pressure to be applied and this irregular pressure produces in turn a vibratory resonance effect on the adapting sleeve that causes this adapting sleeve to deviate from the round shape when the printing sleeve and the core rotate. This variation in the fixed and invariable radial distance can occur, for example, due to the rotational inertia that acts on the adapting sleeve at very high printing speeds.

On the flexographic printing area, with the purpose of increasing the printing surface circumference without increasing the diameter of the rotary core, an adapting sleeve is applied that is arranged between the cylindrical outer surface of a rotary core of a printing machine and the inner surface of a printing sleeve, which carries on its outer cylindrical surface the plates or images to be printed.

The use of an adapting sleeve, as described in the U.S. Pat. No. 5,782,181, which is hereby incorporated herein by this reference for all purposes, allows different printing developments to be reached with the same rotary core.

Nevertheless, an adapting sleeve does not serve as a rigid and invariably concentric connection between the outer diameter of the rotary core and the inner diameter of the printing sleeve. It does not maintain a fixed and invariable radial distance between the outer diameter of the rotary core and the inner diameter of the printing sleeve and therefore will result in the types of unsatisfactory printing qualities described previously.

Various methods for mounting a conventional adapting sleeve are known (defined by a cylindrical hole with a through hole on a rotary core of a printing machine).

One such method employs a rotary core with a pneumatic system.

Even though mounting systems that use hydraulic systems and mounting systems that use mechanical connections are known, these are typically more cumbersome and heavier than the known pneumatic system "air mounting" that uses adapting sleeves, like those described in the U.S. Pat. Nos. 5,819,657, 6,688,226, and 6,691,614, which are hereby incorporated herein by this reference for all purposes. These have an internal core layer expandable radially and a diameter of the inner surface slightly less than the diameter of the outer surface of the rotary core.

Placing the adapting sleeve on one end of the rotary core, it supplies compressed air through certain holes in the rotary core toward the space between the outer surface of the rotary core and the inner surface of the adapting sleeve. The compressed air sufficiently expands the diameter of the inner surface of the conventional adapting sleeve to allow this adapting sleeve to slide over an air chamber, along the outer surface of the rotary core.

When the supply of compressed air is interrupted, the diameter of the inner surface of the conventional adapting sleeve contracts sufficiently to allow the inner surface to grab the outer surface of the rotary core in an interference fit between the rotary core and the conventional adapting sleeve.

The adapting sleeves mounted with air, as described in U.S. Pat. Nos. 5,819,657, 6,688,226; and 6,691,614 comprise: a multi-layer body consisting of: a carbon fiber rigid external cylinder; a cylindrical inner layer with an inner cylindrical surface with a diameter slightly smaller than the diameter of the outer surface of the rotary core and at least an elastically compressible and radially deformable layer arranged against the outer cylindrical surface of the cylindrical inner layer of the adapting sleeve.

When the core of the printing machine rotates, the continued collision of the printing plate with the printing surface in each rotation produces vibrations that increase with the increase in speed in meters per minute. These vibrations cause radial movements of the outer surface of the adapting sleeve with respect to the core and an irregular printing with alternate regions in which the image is printed darker or lighter than it should be.

Another known method for mounting a conventional adapting sleeve employs a rotary core with hydraulic fastening.

This hydraulic system requires an especially configured rotary core and an adapting sleeve fitted with two heads, reinforced with steel inserts, on which a carbon fiber cylinder is mounted.

On each end of the rotary core there is an expandable ring, and the diameter of the expandable ring expands and contracts in accordance with the insertion or removal of incompressible grease that is used hydraulically to expand or contract the rings. Each one of these rings expands to touch the inner surface of the steel insert on the corresponding end of a carbon fiber tube that forms the adapting sleeve.

These hydraulic rotary cores have various disadvantages. They are especially expensive. Moreover, as the rings expand and contract with the use, the rings become exhausted and eventually their expansion is produced nonuniformly, so that they are not round with relation to the central axis of the rotary core, providing irregular prints. Additional disadvantages of increased expense and weight ensue due to the need of using adapting sleeves fitted with reinforced heads with steel inserts to support the pressure of the rings of the rotary core when these rings expand hydraulically.

Another known method for mounting a conventional adapting sleeve employs mechanical fastening.

U.S. Pat. No. 6,647,879, which is hereby incorporated herein by this reference for all purposes, describes a mechanical system for mounting an adapting sleeve on a rotary core. The adapting sleeve has opposite cubes on which a carbon fiber cylinder is mounted. The inner diameter of each of these cubes is expanded and contracted mechanically by a semi-circular collar that has a first end connected pivotally to a first cube and a second opposite end connected to a second cube by an eccentric cam that opens and closes with a pivoting clamp, so that the inner diameter of the collar can be expanded and contracted by the movement of the eccentric cam.

One disadvantage of this mechanical fastening system is the steel-on-steel contact between the inner diameter of the collar and the outer diameter of the rotary core. Each time that this adapting sleeve slides on the rotary core, there inevitably is some damage on the outer surface of the rotary core due to contact with the inner diameter of the collar. Another disadvantage of this mechanical fastening is the inability to absorb or minimize the transmission of vibrations of the rotary core to the printing sleeve, when working at a printing speed greater than 250 meters per minute.

Still another known method for mounting a conventional adapting sleeve employs pneumatic fastening.

US Patent Application Publication No. 2013-0284038 A1, which is hereby incorporated herein by this reference for all purposes, describes an adapting sleeve that has a rigid stabilizer that expands diametrically on each of its ends using compressed air for the mounting of the adapting sleeve on the rotary core of the printing machine.

This adapting sleeve comprises an incompressible outer layer that defines a cylindrical hole element, with a first end, a second end and an outer surface appropriate for the mounting of a printing sleeve.

This adapting sleeve has on its ends a first and a second stabilizer. Each stabilizer comprises: a rigid outer cover that has an internal cavity with an internal conical surface; and an inner covering that can slide axially within the respective internal cavity and that defines an internal cylindrical surface in contact with the rotary core of the printing machine. As the respective internal covering moves axially with respect to the respective rigid outer covering, the diameter of the respective internal cylindrical contact surface changes commensurately.

To allow variation in diameter of the inner cover of the stabilizers, during its pneumatic activation and the fastening of the adapting sleeve to a rotary core, the inner cover of each of the stabilizers is composed of a plurality of sections joined to each other by their adjacent axial borders using an elastic adhesive such as a polymer adhesive.

Because this adaptor sleeve technology employs an quite a few moving pieces inside the adapting sleeve, the costs of manufacturing and the probability of failures increases; especially keeping in mind that its activation requires providing the stabilizers with pressurized air that can be contaminated with impurities.

This adapting sleeve, the same as others mentioned previously, requires the external input of pressurized fluid for its operation (pneumatic or hydraulic), which impedes an autonomous operation thereof.

Overview of Objects Achieved by the Invention

The adapting sleeve of the present invention has some constructive particularities aimed at allowing its autonomous fastening to the rotary core of the printing machine. In accordance with the present invention, the mechanism by which the adapting sleeve is fastened to the rotary core of the flexographic printing machine, is carried by the adapting sleeve itself rather than by the rotary core. The mechanism by which the adapting sleeve of the present invention clamps itself to the rotary core and releases itself from the rotary core is self-contained and need not rely on any mechanism external to the adapting sleeve, yet is readily and conveniently actuatable by the user from outside the adapting sleeve. A hydraulic pressurized device is mounted within the adapting sleeve of the present invention and allows the adapting sleeve to be able to be mounted on any type (hydraulic or pneumatic) of the existing rotary cores, as long as the existing rotary cores have an outer diameter slightly less than the cylindrical hole that extends through the center of the adapting sleeve.

Another of the objectives achieved by the adapting sleeve of the invention is that its hydraulic device for fastening of the adapting sleeve on the rotary core, serves to dampen the vibrations of the inner cylindrical member of the adapting sleeve, thereby significantly impeding or reducing the possibility of transmission of these vibrations to the outer cylindrical member of the adapting sleeve.

The adapting sleeve has an outer cylindrical member formed of rigid material for allowing mounting of a printing sleeve on it. The adapting sleeve includes an inner cylindrical member that defines a cylindrical inner surface configured for mounting the adapting sleeve on a rotary core of a printing machine. The adapting sleeve includes some rigid ring separators mounted between the outer cylindrical member and the inner cylindrical member, and spaced longitudinally, i.e., in the direction of the rotation axis of the adapting sleeve.

To achieve the proposed objectives and in accordance with the invention, this adapting sleeve comprises an inner cylindrical member that includes a material that is elastically deformable under pressure and with a gripping region having an inner diameter slightly larger than that of the rotary core.

The adapting sleeve in accordance with the present invention includes and carries its own autonomous hydraulic device for fastening the adapting sleeve to a rotary core of a printing machine. This hydraulic device is integrated in the adapting sleeve, and in one exemplary embodiment comprises a plurality of hydraulic pads arranged between the inner surface, or larger diameter, of the inner cylindrical member and ring separators that are disposed between the outer cylindrical member and the inner cylindrical member. These hydraulic pads are connected by a hydraulic circuit to a pressurization element, which is actionable manually and activates the pressurization and depressurization of the hydraulic circuit and, consequentially, the inflating or deflating of the hydraulic pads.

The pressurization of the circuit causes hydraulic fluid to enter the hydraulic pads and increasing the pressure within the hydraulic pads sufficiently to cause the volume displaced by the pads increase. This expansion of the volume occupied by the pads results in the application of pressure that elastically deforms the inner cylindrical member radially to tightly grip against the rotary core of the printing machine, with the result of rigidly fastening of the adapting sleeve to the rotary core so that there cannot be any relative movement between the two.

When depressurizing the hydraulic circuit, hydraulic fluid is permitted to escape from the hydraulic pads and decreasing the pressure within the hydraulic pads sufficiently to cause the volume displaced by the pads decrease. This decrease in the volume displaced by the pads allows the inner cylindrical member elastically return to its original unexpanded shape, with the result of releasing of the adapting sleeve from the rotary core of the printing machine.

In this invention, one alternative embodiment of the mentioned hydraulic device can include an annular-shaped or a ring-shaped hydraulic pad mounted between the inner surface, or the smaller diameter, of the inner cylindrical member and each of the ring separators. Another alternative embodiment of the mentioned hydraulic device can include at leach end of the adapting sleeve, several hydraulic pads of smaller surface areas, wherein the pads are evenly spaced apart circumferentially and distributed between the inner cylindrical member and the ring separator at the respective end of the adapting sleeve.

In any case, the inflation of these hydraulic pads causes a radial expansion thereof and in turn causes a deformation of the inner cylindrical member and a reduction of the diameter of the interior passage defined by the inner cylindrical surface, in a gripping region across from the ring separators, thereby causing the inner cylindrical member to press against the rotary core sufficiently to fasten the adapting sleeve to the rotary core in a use position.

In this use position, the hydraulic pressurized fluid contained in the pads acts as a damper of the possible vibrations of the inner cylindrical member during the rotation of the adapting sleeve at high-speed printing. The hydraulic pads also balance the pressure exerted by the inner cylindrical member on the peripheral surface of the rotary core in the areas of the hydraulic pads so as to maintain the adapting sleeve centered with respect to the rotary core of the printing machine.

BRIEF DESCRIPTION OF THE DRAWINGS

Aspects and advantages of the invention are set forth below in the following description, or may be obvious from the description, or may be learned through practice of embodiments of the invention. Those of ordinary skill in the art will better appreciate the features and aspects of such embodiments, and others, upon review of the specification. A full and enabling disclosure of the present invention, including the best mode thereof to one skilled in the art, is set forth more particularly in this specification, including reference to the accompanying figures, in which.

DETAILED DESCRIPTION OF EXEMPLARY EMBODIMENTS OF THE INVENTION

Figure 1:
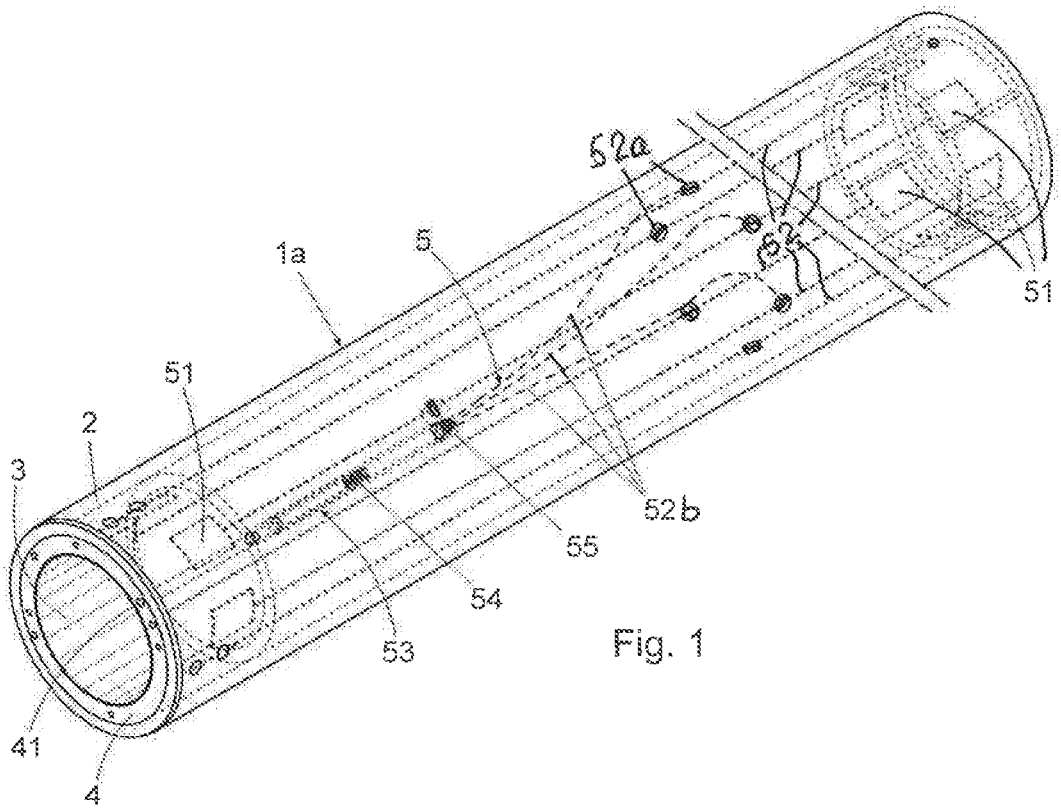
FIG. 1 shows a schematic view in perspective of an exemplary configuration of the adapting sleeve for flexographic printing machines, fitted in this case with hydraulic pads arranged between the inner surface, with greater diameter, of the inner cylinder and the ring separators of the adapting sleeve.

In FIG. 1, the adapting sleeve is generally designated (1*a*) for flexographic printing machines (not shown) and includes a rigid outer cylindrical member (2) that is defined about a central axis of rotation and extends along the central axis from one end of the outer cylindrical member (2) longitudinally to the opposite end of the outer cylindrical member (2). The outer cylindrical member (2) is configured to carry on its exterior surface (22) (FIGS. 5 and 6), a printing sleeve (not shown) that carries the media that transfers ink to the substrate being drawn through the printing machine at very high rates of as much as 1,200 meters per minute. As the mechanism for mounting and dismounting printing sleeves on the exterior surface (22) of the adapting sleeve (1*a*) is not the focus of this disclosure, it suffices to say that at least one of the conventional mechanisms for accomplishing these functions can be applied to the adapting sleeve (1*a*). Among them is connecting the adapting sleeve (1*a*) to a source of pressurized air at 80 to 90 psi, which typically would be available in the printing facility, to expand the cylindrical internal diameter of the printing sleeve sufficiently to slide the printing sleeve onto the exterior surface (22) of the adapting sleeve (1*a*).

Figure 2:
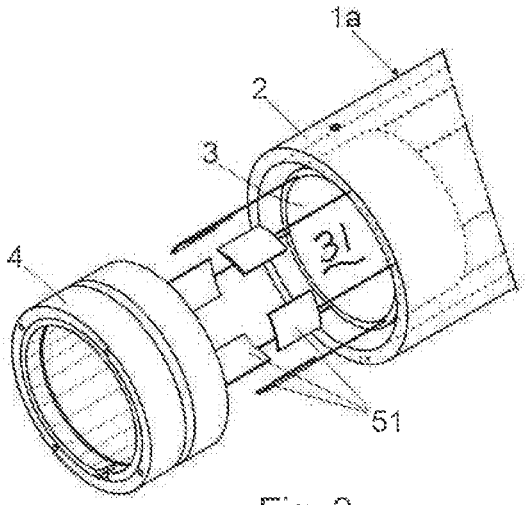
FIG. 2 shows in perspective view an enlarged portion of one end of the adapting sleeve of FIG. 1, in which components are disassembled to reveal the circumferential arrangement of the hydraulic pads.
Figure 5:
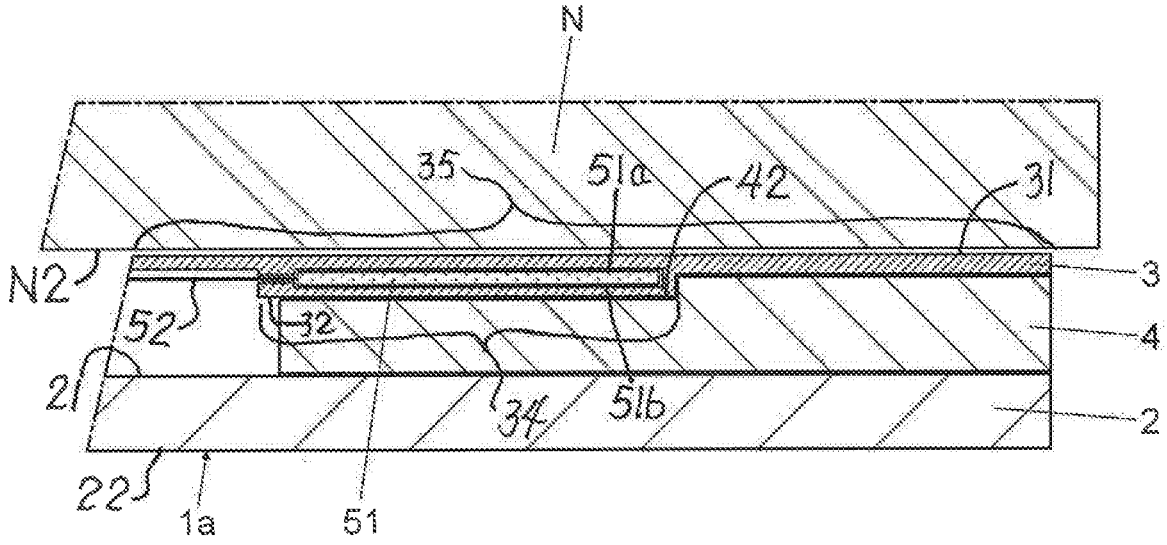
FIG. 5 shows an expanded close-up of the section of FIG. 4 in which one of the depressurized hydraulic pads is seen. In this FIG. 5, the portion of the adapting sleeve mounted on a portion of a rotary core of the flexographic printing machine is shown, expanding the separation between the surfaces across from each other in order to render them more readily discernible.
Figure 6:
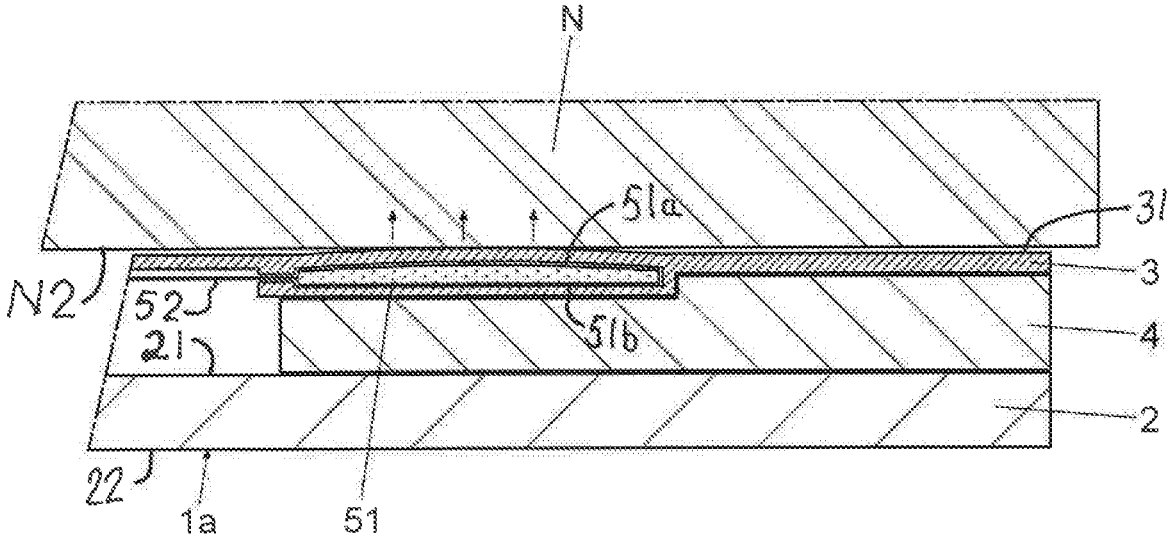
FIG. 6 shows a view similar to FIG. 5, but with the pressurized hydraulic pads in an operating position causing an elastic deformation radially of the inner surface of the inner cylindrical member and its consequent action against the exterior surfaces of the rotary core of a flexographic printing machine.

Moreover, as schematically shown in FIG. 2 for example, the outer cylindrical member (2) circumferentially surrounds an inner cylindrical member (3). As schematically shown in FIGS. 2, 5 and 6 for example, inner cylindrical member (3) is hollow and has an inner cylindrical surface (31) that defines a longitudinally extending interior passage. The diameter of the inner cylindrical surface (31) of the inner cylindrical member (3) is configured to be larger than the exterior diameter of the rotary core (N) (FIGS. 5 and 6) of the flexographic printing machine for which the adapting sleeve (1*a*) is intended. Thus, the interior passage defined by the inner cylindrical surface (31) of the inner cylindrical member (3) comfortably receives therein the rotary core (N) of the printing machine. Accordingly, it is possible to slide the adapting sleeve (1*a*) by hand over the rotary core (N) of the printing machine to mount the adapting sleeve (1*a*) onto the rotary core (N) of the printing machine or dismount the adapting sleeve (1*a*) from the rotary core (N) of the flexographic printing machine. To facilitate the sliding movements of adapting sleeves (1*a*) of relatively longer lengths, the assistance of pressurized air introduced between the inner cylindrical surface (31) of the inner cylindrical member (3) and the rotary core (N) of the printing machine might be required.

Figure 3:
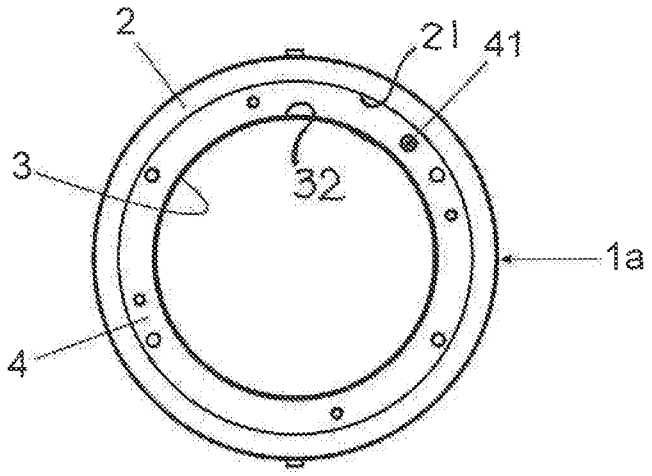
FIG. 3 shows a frontal view of one of the ends of the adapting sleeve of the previous figures.
Figure 4:
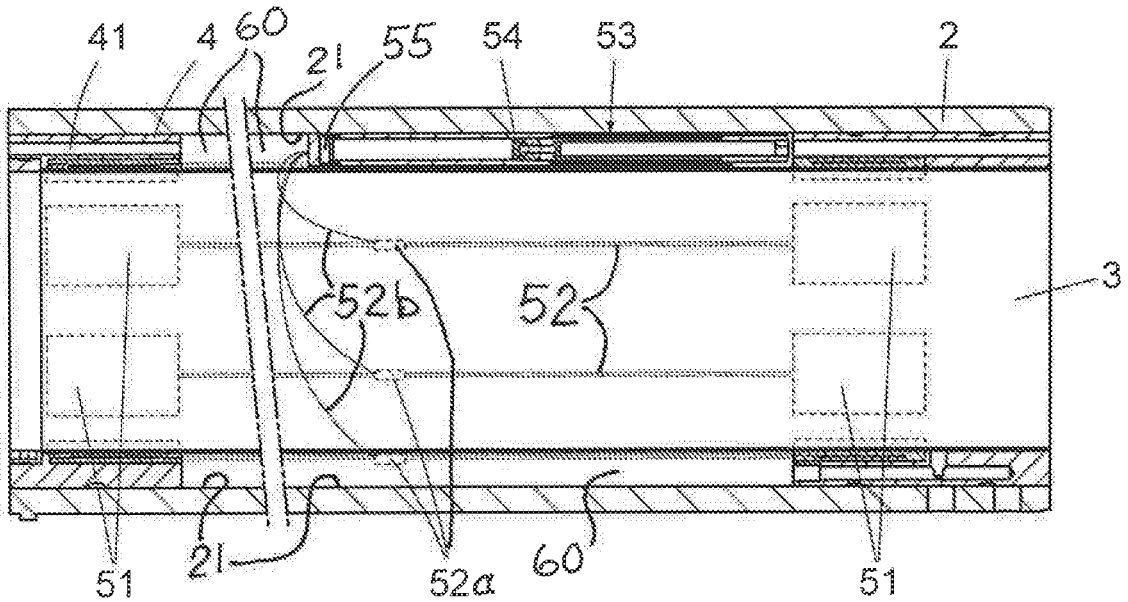
FIG. 4 shows a cross-sectional view of the adapting sleeve of the previous figures sectioned by a longitudinal median plane through the central rotational axis of the adapting sleeve, with components in the background outlined in dashed line.

As schematically shown in FIG. 4, at each opposite end of the adapting sleeve (1*a*) there is a rigid ring separator (4). As schematically shown in FIGS. 3 and 4, each ring separator (4) defines a cylindrical hole through the center thereof. As schematically shown in FIG. 3 for example, each ring separator (4) is mounted between the interior surface (21) of the outer cylindrical member (2) and the exterior surface (32) of the inner cylindrical member (3) and rigidly resists any expansion of the exterior surface (32) of the inner cylindrical member (3).

In this example, the outer cylindrical member (2) and the ring separators (4) are made of carbon fiber, which is both rigid and light in weight, but other similarly rigid materials can be used for the outer cylindrical member (2). However, the inner cylindrical member (3) must be composed of material that is elastically deformable when it is subject to a predetermined amount of pressure greater than normal atmospheric pressure. This elastically deformable material must resume its original shape when the predetermined pressure is removed. A suitable elastically deformable material the inner cylindrical member (3) is provided by fiber glass for example or another material of similar characteristics.

In accordance with the present invention, the adapting sleeve (1*a*) includes a hydraulic device (5) that the user can manually activate in order to selectively apply or remove, as the operator chooses, the predetermined amount of pressure greater than normal atmospheric pressure for elastically deforming the inner cylindrical member (3). By operating the hydraulic device (5) to apply the predetermined amount of pressure, the inner cylindrical member (3) becomes elastically deformed so as to reduce the diameter of the inner cylindrical surface (31) of the inner cylindrical member (3), at least in the end region coextensive with the adjacent ring separator (4) as schematically shown in FIG. 6, by an amount sufficient to clamp tightly around the exterior surface (N2) of a rotary core (N) of a flexographic printing machine, represented schematically in FIGS. 5 and 6. When the hydraulic device (5) removes the predetermined amount of pressure, the inner cylindrical member (3) elastically returns to its original shape in which the diameter of the inner cylindrical surface (31) is again slightly larger than the diameter of the exterior surface (N2) of the rotary core (N) and accordingly permits the user to manually slide the adapting sleeve (1*a*) off of the rotary core (N) of the flexographic printing machine.

Figure 7:
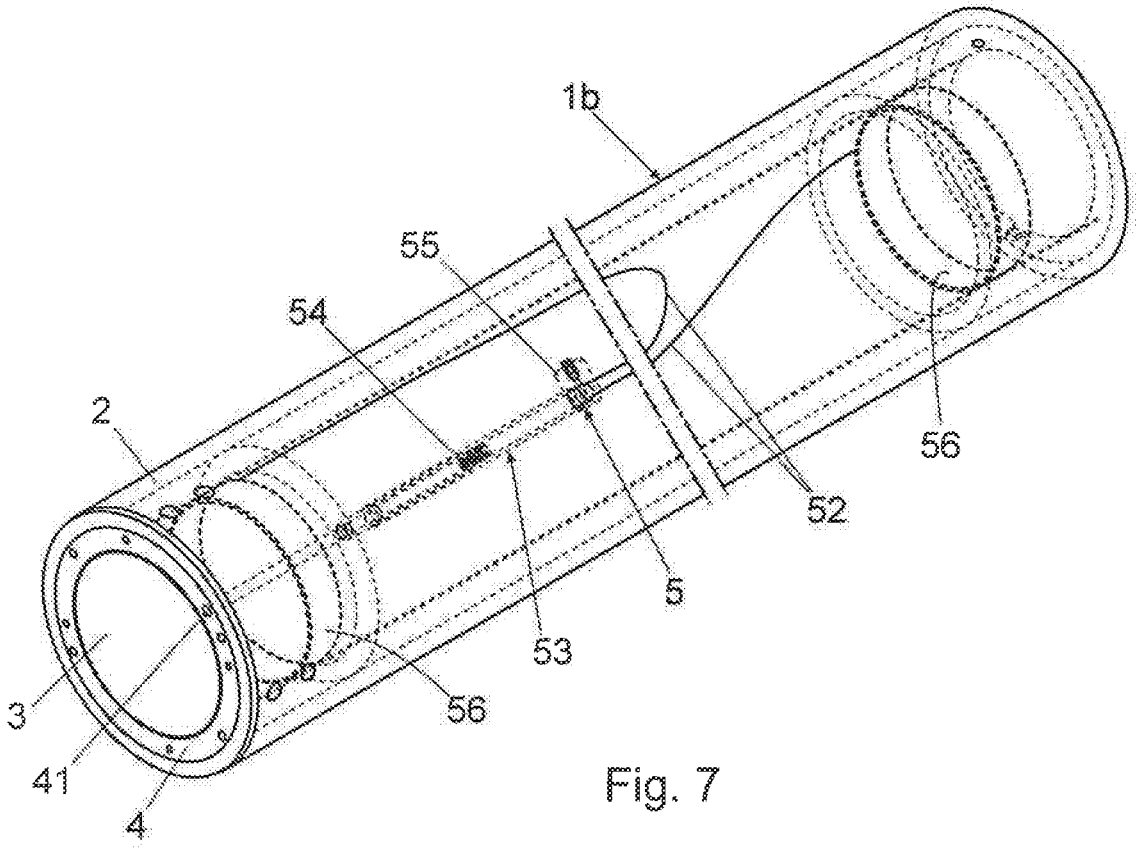
FIG. 7 shows a perspective view of an alternative embodiment of the adapting sleeve in which the hydraulic device includes a ring shaped hydraulic pad arranged between the inner surface of the inner cylinder and each one of the ring separators of this adapting sleeve.

As embodied herein, the hydraulic device (5) in charge of fastening the adapting sleeve (1*a*) to the rotary core (N) includes at least one selectively expandable and compressible hydraulic element. As explained more fully below, the selectively expandable and compressible hydraulic element can take the form of a plurality of discrete hydraulic pads (51) that are circumferentially spaced apart from one another as schematically shown in FIG. 1, or alternatively an annular hydraulic pad (56) as schematically shown in FIG. 7.

As schematically shown in FIG. 5 for example, each hydraulic pad (51) is housed in a respective cavity (33) that is defined internally of a gripping region (34) of the inner cylindrical member (3). As schematically shown in FIG. 5 for example, the end region (35) of the inner cylindrical member (3) is substantially coextensive with the adjacent ring separator (4), and the gripping region (34) desirably is disposed within the end region (35) of the inner cylindrical member (3). Moreover, the gripping region (34) desirably is provided with about twice the radial thickness of the rest of the length of the end region (35) of the inner cylindrical member (3) as well as about twice the radial thickness of portion of the inner cylindrical member (3) that extends axially over most of the length of the inner cylindrical member (3).

As schematically shown in FIG. 5 for example, the inner surface (42) of the ring separator (4) defines a recess that is configured to receive therein the gripping region (34) of the inner cylindrical member (3). This recess desirably extends axially so that it is substantially coextensive with the axial dimension of the gripping region (34) of the inner cylindrical member (3). As schematically shown in FIG. 5 for example, the inner surface (42) of the ring separator (4) rests directly in contact with and firmly against the exterior surface (32) of the gripping region (34) of the inner cylindrical member (3). Moreover, the rigidity of the material composing the ring separator (4) precludes any expansion of the gripping region (34) in the direction of the inner surface (42) of the ring separator (4).

As schematically shown in FIGS. 1 and 2 for example, six hydraulic pads (51) are spaced equidistantly apart around the circumference of each end region of the inner cylindrical member (3). One of these six hydraulic pads (51) is schematically depicted in cross-section in each of FIGS. 5 and 6 for example. Thus, each hydraulic pad (51) is arranged circumferentially between the inner surface (31) of the inner cylindrical member (3) and each of the ring separators (4) arranged near the respective free end of the adapting sleeve (1*a*).

The manner of generating the inner cylindrical member (3) by the successive buildup of layers of elastically deformable material is well understood and accordingly will not need to be described herein in any great detail. As merely one example, US Patent Application Publication No. 2008-0011173 A1, which is hereby incorporated herein by this reference for all purposes, describes embedding a transponder in a printing cylinder. Embedding each hydraulic pad (51) in a respective cavity (33) of the gripping region (34) of the inner cylindrical member (3) can be accomplished in a similar fashion.

As schematically shown in FIGS. 5 and 6 for example, each hydraulic pad (51) desirably is formed from a top sheet (51*a*) that overlays a bottom sheet (51*b*). Each of the top sheet and the bottom sheet desirably is provided by a generally rectangular steel sheet of the same area disposed one on top of the other and length of each sheet desirably is at least twice the width of each sheet. The two opposing longer edges of the overlaid sheets on each of the longer sides of the sheets are welded together to define a respective side edge, and a slight curvature about the longitudinal axis is imposed before welding together the two opposing front edges and the two opposing rear edges of the overlaid top sheet (51*a*) and bottom sheet (51*b*). The degree of this curvature will depend on the diameter of the adapting sleeve (1*a*) in which the hydraulic pad (51) is to be embedded. Each of the hydraulic pads (51) is designed to withstand an internal static pressure of as much as 100 bar, which is more than adequate to provide the desired forces for locking and unlocking the adapting sleeve 1*a* from the exterior surface N2 of the rotary core N. As is apparent from this description, the different gripping requirements of different adapting sleeves 1*a* of differing sizes can be obtained by adjustments between the surface area of the top sheet (51*a*) of each hydraulic pad (51), the number of hydraulic pads (51) and the internal static pressure within each hydraulic pad (51).

The total surface area occupied by these four edges of each hydraulic pad (51) is very much diminished compared to the surface area occupied by either the top sheet (51*a*) or the bottom sheet (51*b*). Thus, the total force exerted from the pressure within each hydraulic pad (51) amounts to much less force transferred through these four edges than the total force that is transferred through either the top sheet (51*a*) or the bottom sheet (51*b*). As schematically shown in FIG. 6, the gauge of the steel sheet that forms the top sheet (51*a*) is much thinner (e.g., 0.02 mm to 1 mm) than the gauge of the steel sheet that forms the bottom sheet (51*b*) in order that the top sheet (51*a*) is more resiliently flexible than the bottom sheet (51*b*) of each hydraulic pad (51). While it is desirable that the top sheet (51*a*) with the thinner gauge of steel should be disposed closer to the inner cylindrical surface (31) of the inner cylindrical member (3), the opposite disposition also can be employed.

Because the exterior surface (32) of the inner cylindrical member (3) is constrained against expansion by the rigid interior surface (42) of the coextensive ring separator (4), any expansion of the hydraulic pad (51) when the adapting sleeve (1*a*) is mounted on the rotary core (N) of the printing machine, causes the inner surface (31) of the inner cylindrical member (3) to undergo a reduction in its diameter that eliminates any gap between the inner surface (31) of the inner cylindrical member (3) and the exterior surface (N2) of the rotary core (N). This is schematically indicated in FIG. 6 by the three parallel arrows pointing away from the hydraulic pad (51) that is expanding so that the top sheet (51*a*) presses the inner surface (31) of the inner cylindrical member (3) against the exterior surface (N2) of the rotary core (N). Given the coefficient of static friction at the interface between the inner surface (31) of the inner cylindrical member (3) and the exterior surface (N2) of the rotary core (N), the total area occupied by the hydraulic pads (51) suffices to generate a substantial clamping force. Moreover, the number of hydraulic pads (51) and the dimensions of each can be engineered so that adequate clamping force can be generated even at relatively low pressures within the hydraulic pads (51). Thus, the inner surface (31) of the inner cylindrical member (3) tightly grips the exterior surface (N2) of the rotary core (N) when the hydraulic pads (51) undergo expansion as schematically depicted in FIG. 6.

As embodied herein and schematically shown by the dashed lines in FIG. 1, the hydraulic device (5) includes a hydraulic circuit that includes a plurality of hydraulic pressure lines (52) that are connected to the hydraulic pads (51) and configured to carry hydraulic fluid to pressurize the hydraulic pads (51) and alternatively carry hydraulic fluid away from the hydraulic pads (51) to depressurize the hydraulic pads. Each of the hydraulic pressure lines (52) desirably is a relatively thin and flexible hollow tube that is lightweight and can follow a curved path without kinking or constricting the internal hollow passage. Each of the hydraulic pressure lines (52) desirably is a stainless steel capillary tube defining a lumen with a diameter in the range of about 0.6 mm to 1.4 mm, which minimizes the amount of hydraulic fluid required to fill the hydraulic circuit, and the exterior diameter of these stainless steel capillary tubes forming the hydraulic pressure lines (52) desirably ranges between about 0.9 mm to 1.7 mm.

As schematically shown in the cross-sectional view of FIG. 4, desirably a hydraulic pad (51) at one end of the adapting sleeve is directly connected via a hydraulic pressure line (52) to a hydraulic pad (51) at the opposite end of the adapting sleeve. Desirably, these two connected hydraulic pads (51) are aligned with each other so that the connecting hydraulic pressure line (52) runs in a straight line and thus is minimized in length and avoids any kinks that otherwise would introduce additional pressure drops in the hydraulic circuit. Moreover, as schematically shown in FIG. 4, the hydraulic pressure lines (52) are carried within the hollow, annular shaped compartment (60) that is defined between the ring separators (4), the outer cylindrical member (2) and the inner cylindrical member (3).

As embodied herein and schematically shown in FIGS. 1 and 4 for example, the hydraulic device (5) includes a pressurization element (53). When the pressurization element (53) is activated manually, it is configured to cause the pressurization or depressurization of this hydraulic circuit and the contraction (deflation) or expansion (inflation) of the hydraulic pads (51) as schematically represented in FIGS. 5 and 6 respectively. The pressurization element (53) desirably is constituted in this exemplary embodiment by a hydraulic cylinder that is fitted with a piston that is moved axially in a longitudinal direction by a threaded rod (54), which is actionable manually from the outside of the adapting sleeve (1*a*) and via an appropriate tool (not shown) that can be inserted through a hole (41) defined for this purpose through one of the ring separators (4). The hydraulic fluid chamber of the hydraulic cylinder is connected via the hydraulic pressure lines (52) to the hydraulic pads (51). Use of the tool to effect manual rotation of the threaded rod (54) in one direction moves the piston to reduce the volume in the hydraulic chamber, thus commensurately increasing the pressure in the hydraulic circuit and expanding the hydraulic pads (51), as schematically indicated by the three vertical arrows depicted in FIG. 6. Similarly, manual rotation of the threaded rod (54) in the opposite direction moves the piston to increase the volume in the hydraulic chamber, thus commensurately decreasing the pressure in the hydraulic circuit and depressurizing the hydraulic pads (51) to resume their neutral volume schematically shown in FIG. 5. However, the pressurization element (53) can be any other type that allows pressurizing and depressurizing the hydraulic circuit and the hydraulic pads (51) within the space constraints imposed by the configuration of the adapting sleeve (1*a*) and thereby effecting in any case an autonomous operation of the hydraulic device (5).

During printing operations of the flexographic printing machine, various external printing pressures can be transmitted to the adapting sleeve (1*a*, 1*b*). When these external printing pressures are transmitted from the exterior surface (22) of the adapting sleeve (1*a*) to the gripping region (34) of the inner cylindrical member (3), these external printing pressures can generate pressure pulses that can travel through the hydraulic circuit via the pressure lines (52). In order to eliminate or minimize any adverse effects from such pressure pulses, as schematically shown in FIGS. 1 and 4, the hydraulic circuit includes a plurality of connectors (52*a*), which are hydraulic distributors welded into the hydraulic pressure lines (52). Each hydraulic distributor (52*a*) in each connector line (52) is disposed centrally between both opposite ends of the connector line (52), and thus equidistant between each of the hydraulic pads (51) at each opposite end of the pressure line (52). By this arrangement, pressure pulses that originate at opposite ends of the adapting sleeve (1*a*) will arrive simultaneously at the centrally located hydraulic distributor (52*a*) in each connector line (52), where the oppositely traveling pressure pulses will cancel out one another. The pressurization element (53) is connected to each of the hydraulic pressure lines (52) via a respective hydraulic distributors (52*a*), which are connected to the pressurization element (53) via one of the individual hydraulic feeder lines (52*b*) that forms part of the hydraulic circuit. Thus, as schematically shown in FIG. 4, one hydraulic pad (51) at one end of the adapting sleeve (1*a*) is paired with an hydraulic pad (51) at the opposite end of the adapting sleeve (1*a*), and these two paired hydraulic pads (51) are connected via an hydraulic pressure line (52) that includes one of the hydraulic distributors (52*a*), which in turn is connected to the pressurization element (53) via one of the individual hydraulic feeder lines (52*b*) that forms part of the hydraulic circuit.

As embodied herein and schematically shown in FIG. 1 for example, the hydraulic device (5) also includes a pressure limiter (55) that impedes the pressurization of the hydraulic circuit (52) above a predetermined value to guard against damage to the components of the hydraulic device (5) if the pressurization element (53) should be activated uncontrollably. The pressure limiter (55) desirably is provided by a relief valve with a bellows that yields when subjected to a pressure greater than the predetermined pressure indicative of the pressurization element (53) having been uncontrollably activated. As embodied herein and schematically shown in FIG. 1 for example, the pressure limiter (55) is disposed between the pressurization element (53) and the hydraulic pressure lines (52) that connect to the hydraulic pads (51). Moreover, as schematically shown in FIG. 4, the hydraulic pressure lines (52), the pressurization element (53), the threaded rod (54) and the pressure limiter (55) are carried within the hollow, annular shaped compartment that is defined between the ring separators (4), the outer cylindrical member (2) and the inner cylindrical member (3).

Because the adapting sleeves (1*a*) of the present invention are designed to be clamped onto rotary cores (N) that are driven at very high rotational speeds, the pressurization element (53), threaded rod (54), and the pressure limiter (55) must be rigidly fastened to the exterior surface (32) of the inner cylindrical member (3). As schematically shown in FIG. 4, this desirably is accomplished by providing an axially formed channel as part of the exterior surface (32) of the inner cylindrical member (3) and adhesively cementing the pressurization element (53), threaded rod (54), and the pressure limiter (55) in this first channel. Moreover, in order to dynamically compensate for the weight of the hydraulic device (5), and in particular the pressurization element (53), threaded rod (54), and the pressure limiter (55), there desirably is provided in the exterior surface (32) of the inner cylindrical member (3), a mirror channel that is displaced 180° circumferentially from the first channel. A compensating dead weight desirably is cemented in this mirror channel so that the adapting sleeve (1*a*) is dynamically balanced.

After the hydraulic device (5) and the compensating dead weight have been attached to the exterior surface (32) of the inner cylindrical member (3), the inner cylindrical member (3) is dynamically balanced before being inserted into the hollow chamber defined by the interior surface (21) of the outer cylindrical member (2). A respective rigid ring separator (4) closes off each opposite end of the outer cylindrical member (2). Conventional adhesives then are applied to permanently affix each ring separator (4) to the interior surface (21) of the outer cylindrical member (2) and the exterior surface (32) of the inner cylindrical member (3).

As schematically shown in FIG. 5, the hydraulic circuit (52) is depressurized and the hydraulic pads (51) are deflated to resume their unexpanded shape. The inner surface (31) of the inner cylindrical member (3) defines a continuous hollow passage defining a diameter that is constant and slightly greater than the exterior surface (N2) of the rotary core (N) of the printing machine, thereby allowing the mounting and dismounting of the adapting sleeve (1*a*) on this rotary core (N).

As schematically shown in FIG. 6, when the hydraulic circuit (52) is pressurized, the hydraulic pads (51) are inflated. Such inflation causes a radial deformation of the inner surface (31) of the inner cylindrical member (3) that reduces the diameter of the inner surface (31) sufficiently to press against the perimeter areas of the exterior surface (N2) of the rotary core (N), thereby establishing the fastening of the adapting sleeve (1*a*) with respect to the rotary core (N) so that the adapting sleeve (1*a*) and the rotary core (N) rotate together as a single unit without an relative movement between them.

This deformation of the inner cylinder (3) toward its interior due to the action of the hydraulic pads (51) is facilitated by the elasticity of the material forming this inner cylinder (3) and to the rigidity both of the ring separators (4) and the outer cylinder (2).

A perspective view of an alternative embodiment of an adapting sleeve (1*b*) is schematically shown in FIG. 7. Only the variance of adapting sleeve (1*b*) from the adapting sleeve (1*a*) of the previous figures need be described. The essential difference is the substitution of an annular hydraulic pad (56) for a plurality of the hydraulic pads (51) arranged circumferentially. The annular hydraulic pad (56) desirably is formed from a top cylindrical sheet that concentrically overlays a bottom cylindrical sheet. Each of the top cylindrical sheet and the bottom cylindrical sheet desirably is provided by a steel cylinder open at both opposite ends. The overlaid edges of the open ends of the overlaid cylindrical sheets are welded together to define a respective end edge. In this alternative embodiment of adapting sleeve (1*b*), the cross-sectional portions of the views of FIGS. 4, 5 and 6 would be applicable for illustrative purposes. The cavity (33) that is defined internally of a gripping region (34) of the inner cylindrical member (3) forms a continuous circumferentially extending channel instead of the separate individual compartments arranged circumferentially as in the embodiment of the adapting sleeve 1*a* shown in FIG. 1. Thus, in this embodiment of the adapting sleeve (1*b*) schematically shown in FIG. 7, the hydraulic device (5) of the adapting sleeve (1*b*) includes an annular hydraulic pad (56) mounted between the inner cylindrical member (2) and each of the ring separators (4). Each an annular hydraulic pad (56) performs the function of the plurality of discrete hydraulic pads (51) distributed circumferentially at each opposite end of the embodiment of the adapting sleeve (1*a*) shown in FIGS. 1-6.

Additional alternative embodiments of an adapting sleeve (1*a*, 1*b*) can include either a third plurality of hydraulic pads (51) or a third annular hydraulic pad (56) mounted in the central region of the adapting sleeve (1*a*, 1*b*) essentially intermediate between the two ends thereof. Such an embodiment is particularly desirable when additional clamping force between the adapting sleeve (1*a*, 1*b*) and the rotary core (N) is desired, such as might be warranted by the length or diameter of the adapting sleeve (1*a*, 1*b*). In such embodiments, each of the third plurality of hydraulic pads (51) or a third annular hydraulic pad (56) can form a terminus point of the hydraulic circuit as schematically depicted in FIGS. 5 and 6 for example. Alternatively, in such embodiments, the third plurality of hydraulic pads (51) or a third annular hydraulic pad (56) can form a pass through component of the hydraulic circuit such that the hydraulic pressure lines (52) connect to them from the first plurality of hydraulic pads (51) or first annular hydraulic pad (56) at one end of the adapting sleeve (1*a*, 1*b*) and also connect from them to the second plurality of hydraulic pads (51) or annular hydraulic pad (56) at the opposite end of the adapting sleeve (1*a*, 1*b*).

Each example is provided herein by way of explanation of the invention, not limitation of the invention. As the nature of the invention is described sufficiently, as well as an example of the presently preferred configuration, the materials, shape, size and disposition of the elements described may be modified, as long as it does not involve an alteration of the essential characteristics of the invention that are claimed. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

What is claimed is:

1. Adapting sleeve for a flexographic printing machine having at least one cylindrical rotary core that can be rotatably driven about a rotational axis, the adapting sleeve comprising:

an outer cylindrical member made of a rigid material and defining a cylindrical inner surface, the outer cylindrical member defining a first end and a second end disposed longitudinally spaced apart from the first end;

an inner cylindrical member defining a cylindrical, diametrically-expandable inner surface having a diameter larger than the diameter of the rotary core of the printing machine for slidably mounting the inner cylindrical member on the rotary core of the printing machine, the inner cylindrical member defining a first end and a second end disposed longitudinally spaced apart from the first end;

a first ring separator mounted between the first end of the outer cylindrical member and the first end of the inner cylindrical member;

a second ring separator mounted between the second end of the outer cylindrical member and the second end of the inner cylindrical member, wherein a hollow compartment is defined between the ring separators, the outer cylindrical member and the inner cylindrical member; and wherein the inner cylindrical member defines a first gripping region substantially coextensive with a recess defined in the first ring separator, the first gripping region defining a first cavity therein; and a first selectively expandable and compressible hydraulic element is disposed in the first cavity of the first gripping region of the inner cylindrical member.

2. Adapting sleeve, as per claim 1, wherein the selectively expandable and compressible hydraulic element includes a hydraulic pad.

3. Adapting sleeve, as per claim 1, wherein the selectively expandable and compressible hydraulic element includes an annular-shaped hydraulic pad arranged circumferentially around the first ring separator.

4. Adapting sleeve as per claim 1, further comprising a hydraulic cylinder connected to the selectively expandable and compressible hydraulic element and including a piston having a coupling, wherein the piston is configured for axial movement by rotational movement of a threaded rod that is selectively manually attachable to and detachable from the coupling of the piston.

5. Adapting sleeve, as per claim 4, wherein the first ring separator defines an access conduit through which the threaded rod is afforded access for selectively manually attaching to and detaching from, the coupling of the piston.

6. Adapting sleeve, as per claim 4, wherein hydraulic fluid fills the hydraulic cylinder, which is configured for changing its volume commensurate with axial movement of the piston.

7. Adapting sleeve as per claim 1, wherein the selectively expandable and compressible hydraulic element forms part of a hydraulic circuit that includes a hydraulic pressure line connected to the selectively expandable and compressible hydraulic element and formed of relatively thin and flexible hollow tubing that defines an internal hollow passage and is lightweight.

8. Adapting sleeve, as per claim 7, further comprising an hydraulic distributor connecting the hydraulic pressure line and the hydraulic cylinder.

9. Adapting sleeve as per claim 1, wherein the inner cylindrical member defines a second gripping region substantially coextensive with a recess defined in the second ring separator, the second gripping region defining a second cavity therein, and wherein a second selectively expandable and compressible hydraulic element is disposed in the second cavity of the second gripping region of the inner cylindrical member.

10. Adapting sleeve, as per claim 9, further comprising a first hydraulic pressure line connecting the hydraulic cylinder to the first the selectively expandable and compressible hydraulic element, and a second hydraulic pressure line connecting the hydraulic cylinder to the second the selectively expandable and compressible hydraulic element.

11. Adapting sleeve, as per claim 10, further comprising an hydraulic distributor that is disposed equidistant between and connecting the first hydraulic pressure line and the second hydraulic pressure line.

12. Adapting sleeve, as per claim 11, further comprising a hydraulic cylinder connected to the hydraulic distributor.

13. Adapting sleeve, as per claim 1, further comprising a pressure limiter that is configured and disposed to prevent overpressurization of the first selectively expandable and compressible hydraulic element.

14. Adapting sleeve, as per claim 1, wherein the inner cylindrical member is composed of material that is elastically deformable radially due to the action of the selectively expandable and compressible hydraulic element.

15. Adapting sleeve, as per claim 1, wherein the inner cylindrical member is formed of fiber glass.

16. A method of fastening an adapting sleeve as per claim 1 non-rotatively relative to a cylindrical rotary core of a flexographic printing machine, the method comprising the steps of:

sliding adapting sleeve onto the cylindrical rotary core; and selectively expanding the selectively expandable and compressible hydraulic element so as to displace the inner cylindrical member radially inwardly to press the inner surface of the inner cylindrical member against the rotary core of the printing machine with the consequent fastening of the adapting sleeve to the rotary core of the flexographic printing machine.

* * * * *